US006344856B1

(12) United States Patent
Lum et al.

(10) Patent No.: US 6,344,856 B1
(45) Date of Patent: Feb. 5, 2002

(54) TEXT OPTIMIZATION

(75) Inventors: Sanford S. Lum, Whitehall, PA (US); Adrian Hartog, Toronto (CA); Fridtjof Martin Georg Weigel, Scarborough (CA); Josh Grossman, Toronto (CA); Dan O. Gudmundson, Newmarket (CA)

(73) Assignee: ATI Technologies Inc., Markham (CA)

( * ) Notice: Subject to any disclaimer, the term of this patent is extended or adjusted under 35 U.S.C. 154(b) by 0 days.

(21) Appl. No.: 08/425,741

(22) Filed: Apr. 20, 1995

(51) Int. Cl.[7] ..... G09G 5/00

(52) U.S. Cl. ..... 345/562; 345/548; 345/552; 345/568; 345/538

(58) Field of Search ..... 345/132, 133, 345/185, 186, 189, 192, 115, 116, 130, 131, 525, 526, 507, 509, 515; 395/100, 164, 165, 166, 130, 131, 115, 116, 193; 31/552, 562, 564, 565, 568, 571, 572, 548, 536, 537, 551, 538

(56) References Cited

U.S. PATENT DOCUMENTS 5,047,760 A * 9/1991 Trevett et al. ..... 345/201
5,522,082 A * 5/1996 Guttag et al. ..... 395/100
5,526,025 A * 6/1996 Selwar et al. ..... 345/201
5,590,260 A * 12/1996 Morse et al. ..... 345/192

* cited by examiner

*Primary Examiner*—Lun-Yi Lao
(74) *Attorney, Agent, or Firm*—Ogilvy Renault

(57) ABSTRACT

A method of providing text data for display in a processor controlled apparatus comprised of storing data defining a text character in a memory, in packed monochrome bit map form, addressing the memory to read the text character data, providing the text character to a graphics processor circuit, performing a bitblt operation on each bit of the text character while providing a color attribute, and storing the packed text character having a color attribute for subsequent display.

12 Claims, 5 Drawing Sheets

TEXT OPTIMIZATION

FIELD OF THE INVENTION

Figure 1:
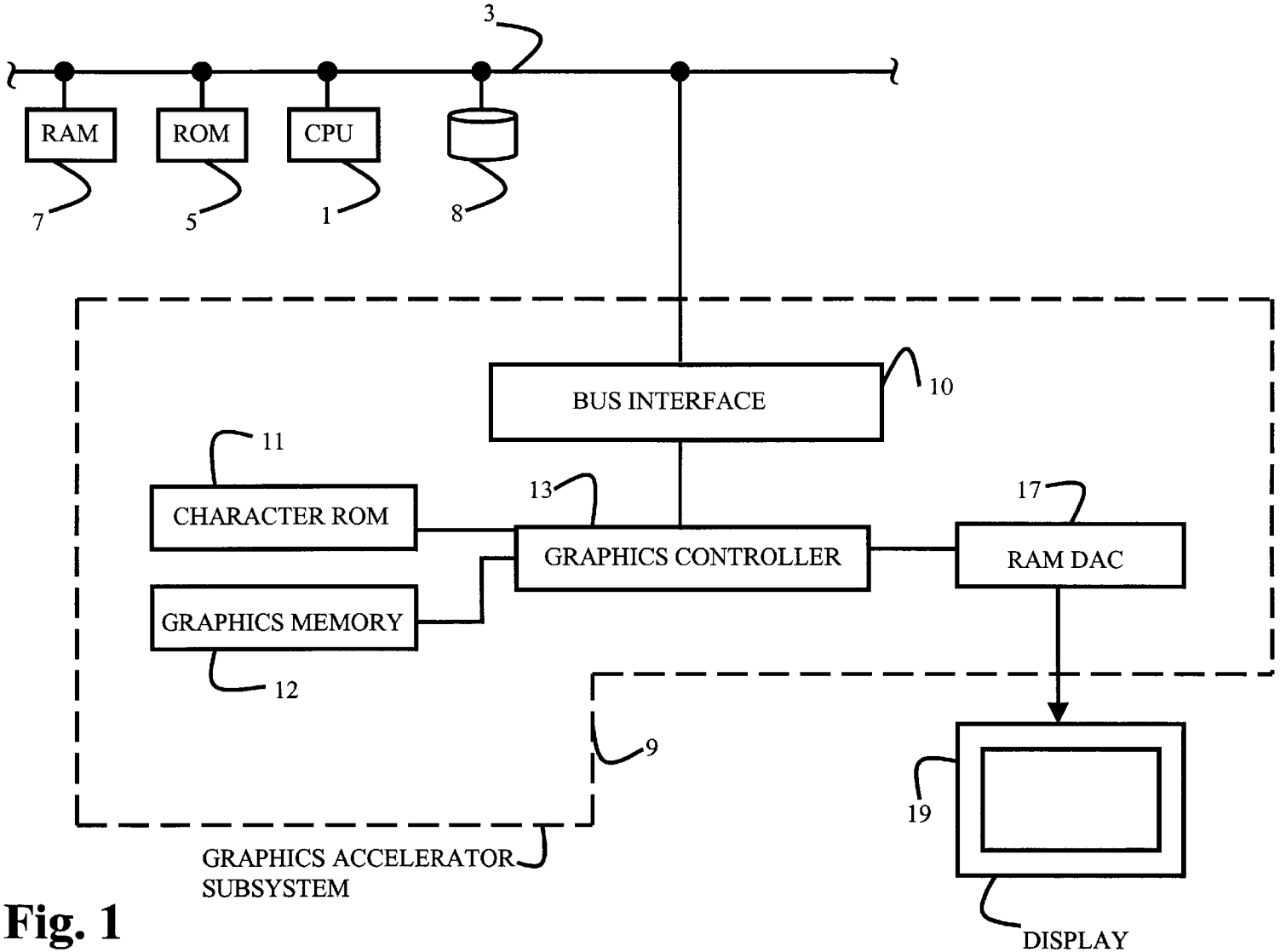

This invention relates to the field of computer graphics processors and particularly to methods of decreasing the processing time required to provide text data for display.

BACKGROUND TO THE INVENTION

Display adapters on computer systems based on the Intel x86 microprocessor architecture, in particular Color Graphics Adapter (CGA), Monochrome Display Adapter (MDA), Enhanced Graphics Adapter (EGA) and VGA have contained dedicated text modes. Text modes are fast and memory efficient because only two bytes are used to described each character (the two bytes defining the ASCII code for the character, and an attribute), but they do not look appealing when displayed because each character has a fixed cell size, and the display resolution that they are shown in is very low. With the advent of the graphical user interface (GUI) such as Windows (sold by Microsoft Corporation), scalable outline fonts, high resolution monitors and inexpensive memory, all native applications of the GUI have been required to be run in All Points Addressable (APA) mode, otherwise known as graphics mode. A notable difference between text mode and graphics mode was that each pixel could be individually addressed in graphics mode while only characters could be addressed in text mode.

Since GUIs operate in graphics mode, the amount of time spent creating the graphics by processing circuits of a computer (overhead) is very high. In graphics mode, text is dealt with as a graphic entity, with each pixel addressed. Since the computer communicates with the user in text as well as with images, performance of the computer in processing text is very important.

In order to improve performance of the computer, graphics accelerators were introduced. The graphics accelerator takes a load off the main computer processor, being designed specially to process graphics data with little call on the main processor.

In the Windows GUI, text is displayed by each character being rendered into an arbitrary sized monochrome bitmap, which is then passed to a display driver. The driver then causes the bitmap to be displayed. Graphics accelerator display drivers typically move the bitmap to an off-screen memory cache on the graphics accelerator, and then performs a monochrome to two color expansion bit block transfer (bitblt) from the off-screen to an on-screen memory. Since the main processor is not intensively used for this process, the host expansion bus of the computer to which both the main processor and the display driver are connected is not required to carry communication traffic between the main processor and the display driver, thus allowing faster communication between other elements connected to the expansion bus and the main processor.

In a monochrome expansion bitblt, an area of graphics memory is read. One bit is read for each destination pixel. If a bit is a '1', then a foreground color and foreground ALU (processing) function are used to write a destination pixel. Otherwise a background color and background ALU function are used to write the destination pixel.

In a graphics accelerator such as the IBM model 8514/A or equivalents, sparse monochrome (i.e. only one bit in each byte) sources have been used for the color expansion of one destination pixel, as described in the immediately preceding paragraph.

Character bitmaps provided by the Windows GUI are mostly packed, that is, all bits per source byte are used during the bitblt, except that if a character width is not a multiple of 8, the bits at the end of every scan line are padded with zeroes until each scan line of the character has a length which is a multiple of 8.

Character bitmaps are rectangular. Accelerators generally draw these rectangles in an X major fashion, from left to right and from top to bottom, for memory performance reasons. Each character bitmap generally follows the previous in an X major fashion, from left to right and top to bottom, as when writing a left to right language, such as English.

SUMMARY OF THE INVENTION

The present invention provides an advantage of the use of a monochrome bitmap provided by the main processor, as in the text based architecture as described above, but rather than it being sparse as in the prior art, it is packed. Each bit of source datum defining a character is used in a color expansion process by the graphics accelerator. Since the character information is packed monochrome, the data passing to the graphics processor via the main expansion bus of the host computer is less than would be required if the full character bitmap were carried by the main expansion bus.

In accordance with an embodiment of the invention, a method of providing text data for display in a processor controlled apparatus is comprised of storing data defining a text character in a memory, in packed monochrome bit map form, addressing the memory to read the text character data, providing the text character to a graphics processor circuit, performing a bitblt operation on each bit of the text character while providing a color attribute, and storing the packed text character having a color attribute for subsequent display.

In accordance with another embodiment, where the full character bitmapped data provided by a GUI such as Windows is provided at a source, when the destination rectangle of a character advances in a Y direction, the source aligns to the nearest byte, i.e. the beginning of a scan line of pixels, even if the complete preceding line of pixels has not been completely read. This allows the bitmap data provided by Windows to be written directly to an off-screen memory cache without requiring modification, and therefore without requiring processing, by the main computer processor.

In accordance with this embodiment, a method of providing text data for display in a processor controlled apparatus is comprised of storing data defining a text character in a memory, performing a bit block transfer (bitblt) operation on the text character by moving a source block of pixels of the text character from a source portion of the memory to a destination portion of the memory, the bitblt operation being performed by (i) reading pixels in an X direction from the source block of pixels until the end of a destination block of pixels is reached while writing said pixels in an X direction to the destination portion of the memory, (ii) advising a destination block of pixels pointer in a Y direction which is orthogonal to the X direction and resetting the destination block to an X origin of said destination block of pixels, and (iii) reading a next line of the source block of pixels in an X direction from the beginning of a next byte of the source block of pixels while skipping any bits in the line of the source block of pixels remaining unread.

In accordance with another embodiment, destination side effects may be obtained automatically to place text characters in order depending on the type of language used. It will be recognized that European languages tend to be written with characters left to right, Asian languages tend to be written top to bottom, and Mediterranean languages tend to be written right to left. In this embodiment the direction of writing to a destination can be programmed, whereby in a bitblt, source characters are automatically stored at a destination with no displacement, with a right to left displacement, with a left to right displacement, with a top to bottom displacement, or with a bottom to top displacement, the width of the displacement also being programmable.

In accordance with another embodiment a method of providing text data for display in a processor controlled apparatus is comprised of storing data defining a text character in a graphics accelerator memory, performing a bit block transfer (bitblt) operation on the text character comprising reading source bits defining a block of text characters line by line in an X direction, defining a destination pointer for each block with X and Y coordinates, adding an offset to one of the X and Y coordinates, and writing the text character to a destination, whereby each text character block is written to said destination offset from a previous block by said added offset, for subsequent display in a predetermined order in said destination.

BRIEF INTRODUCTION TO THE DRAWINGS

Figure 2:
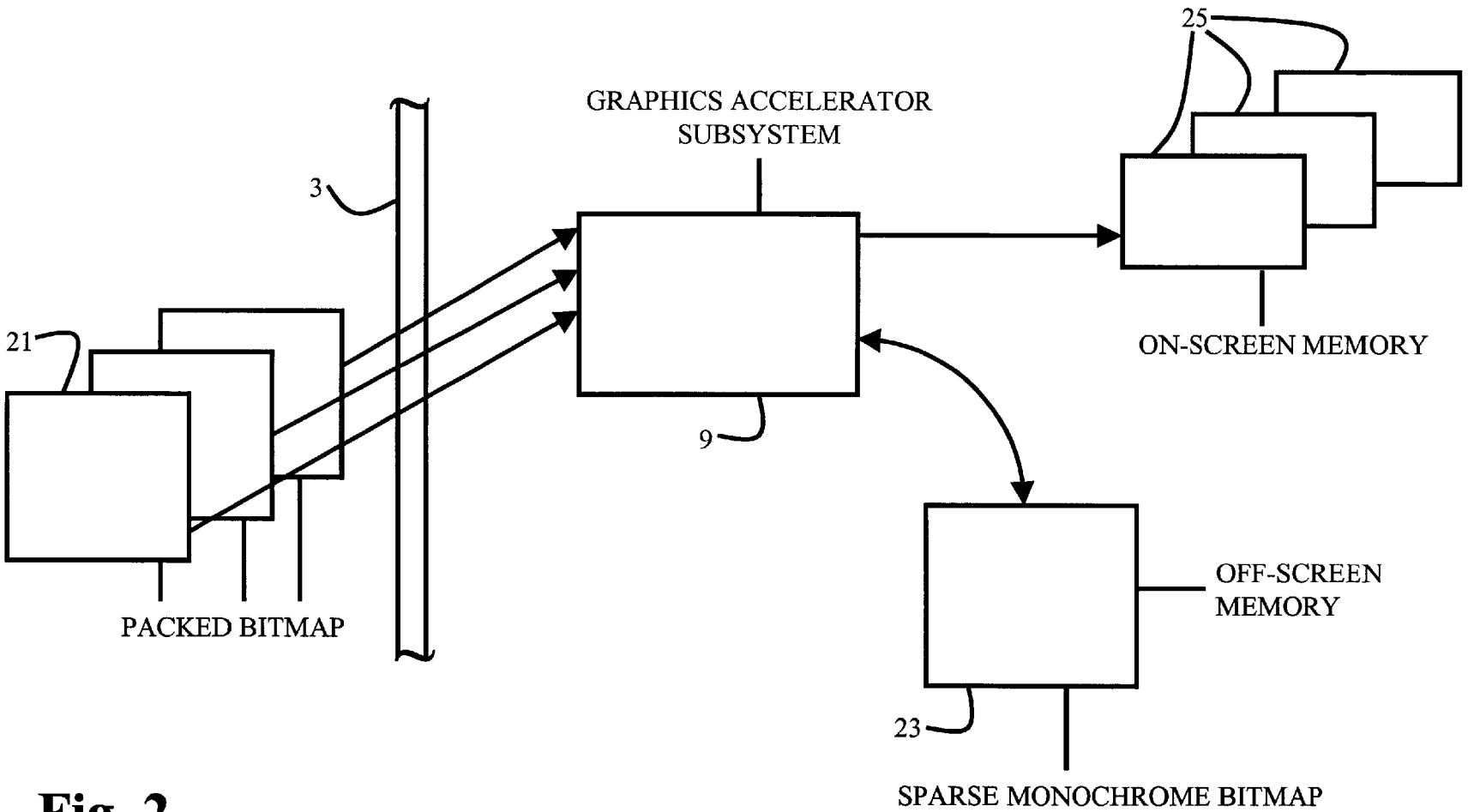
Fig. 2 Prior Art
Figure 3:
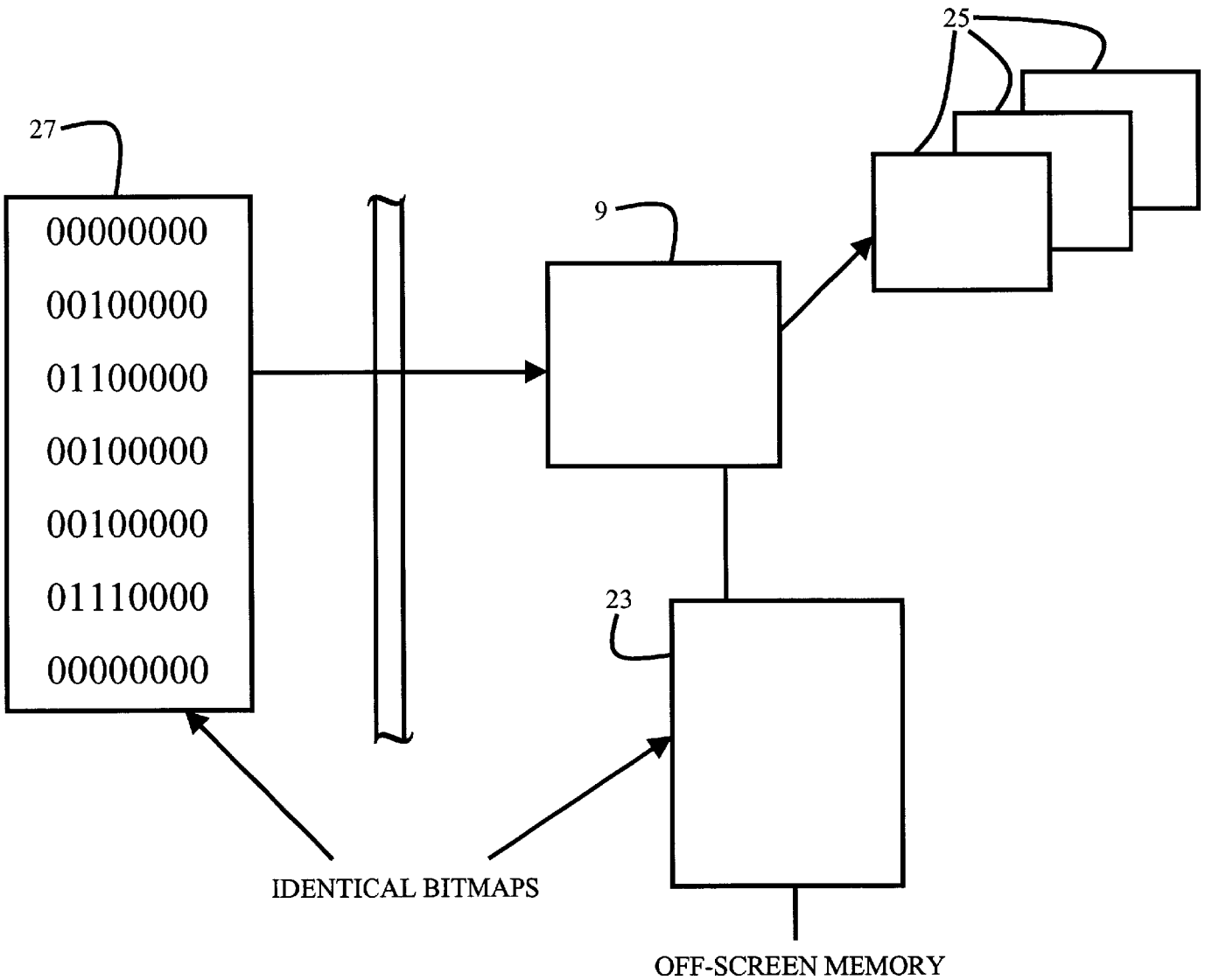
Figure 4:
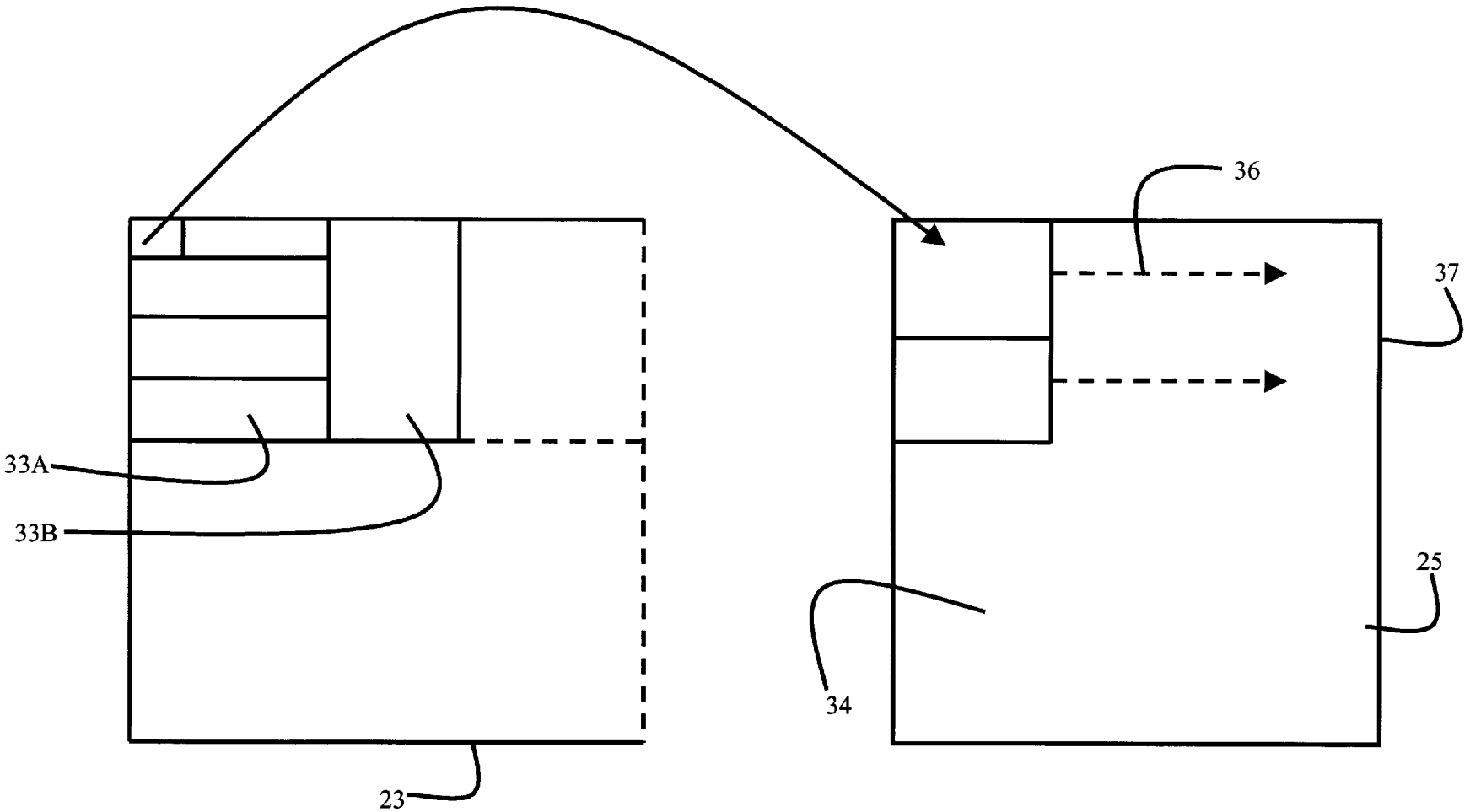
Figure 5:
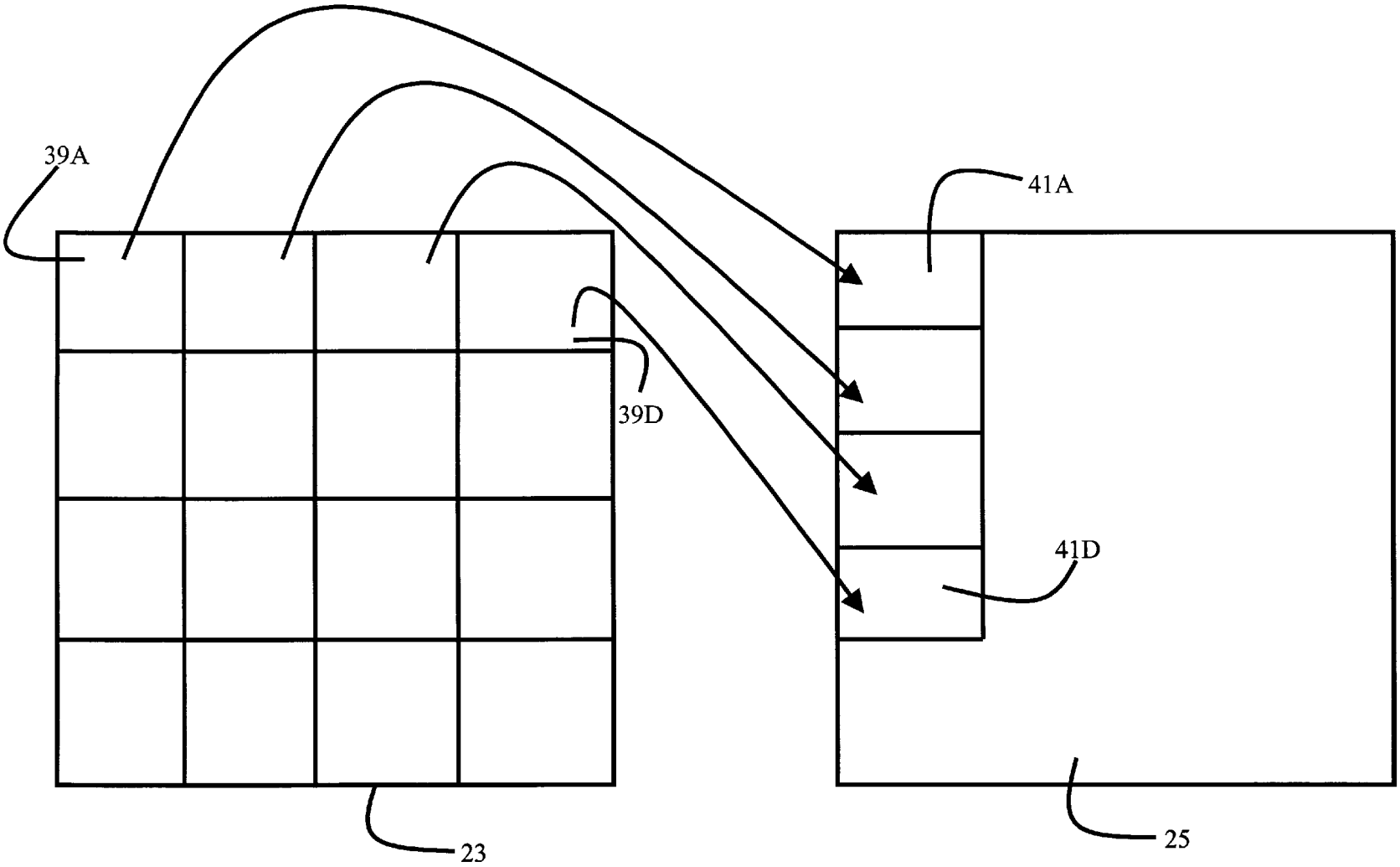

A better understanding of the invention will be obtained by reading the description of the invention below, with reference to the following drawings, in which:

FIG. 1 is a block diagram of a computer which can be used to carry out the inventive methods, FIG. 2 is a schematic diagram illustrating how a prior art method operates, FIG. 3 is a schematic diagram illustrating how one embodiment of the present invention operates, FIG. 4 is a schematic diagram illustrating how another embodiment of the invention operates, and FIG. 5 is a schematic diagram illustrating how still another embodiment of the invention operates.

DETAILED DESCRIPTION OF THE INVENTION

Turning to FIG. 1, the architecture of a computer which contains a CGA or MDA graphics accelerator subsystem is shown. A main processor, CPU 1, is connected to an expansion bus 3, to which a read only memory ROM 5, a random accessor memory 7, a hard disk drive 8, etc., are connected for communication with CPU 1. A graphics accelerator subsystem 9 is connected to the expansion bus 3 via a bus interface 10. A character ROM 11 and a graphics memory 12 are connected to a graphics controller 13. An output of the graphics controller 13 is connected to RAMDAC 17. An output of RAMDAC 17 is connected to a display 19.

Operation of a computer in accordance with the prior art is well known, and a description may be found in the texts "Graphics Programming for the 8514/A" by Jake Righter & Bud Smith, published by M&T Publishing, Inc., Redwood City, Calif., copyright 1990, and "Fundamentals of Interactive Computer Graphics", by J. D. Foley and A. Van Dam, published by Addison-Wesley Publishing Company of Reading, Massachusetts, copyright 1982. In respect of display of text, data defining fixed characters are stored in ROM 11, which data is accessed by CPU 1 operating under control of a program stored in RAM 7, and are provided through bus interface 10 to graphics accelerator subsystem 9. Fixed character data are stored in ROM 11 while ASCII code and attribute data are stored in graphics memory 12.

In order to display the data, graphics controller 13 performs a bitblt operation on the data, accessing it, expanding it to define color, and writing it back to on-screen memory. This memory is subsequently read out and sent to the RAMDAC 17. RAMDAC 17 converts them to analog form, and provides the resulting analog signal to display 19 from which it can be viewed.

Thus in accordance with this form of the prior art, the data stored in ROM was character based, data describing a character which was addressable by an ASCII number (code). To access that data, a two byte character that was stored in RAM 12, one identifying the character ASCII code and one identifying an attribute, such as color, intensity, etc. was used. However, the characters, being predefined and identifiably by only two bytes, had a fixed cell size and low resolution which is generally undesirable to modern computer users.

In accordance with another form of the prior art, data defining character form and size is stored first on the hard disk drive 8 and then in the RAM 7 in the form of code that either defines each pixel of each font, size and style that is to be used, or in the form of scalable vectors defining stroke length and direction to draw each character. This form of prior art is used in modern GUIs.

In the last-noted form of prior art, the bitmap data defining each pixel is passed to the graphics accelerator system 9, which stores the character data in an arbitrarily sized monochrome bitmap. The CPU contains a display driver which moves the bitmap to an off-screen memory cache. It then performs a bitblt from the off-screen memory cache to an on-screen memory, while expanding the bitmap by a 2 color expansion.

FIG. 2 illustrates how this prior art method operates. Code defining a packed monochrome bit map 21 in which each pixel is defined is processed by the CPU to make it sparse, then passes via the expansion bus 3 to subsystem 9, where it is stored in monochrome form in an off-screen memory 23, in sparse monochrome form. The bit map is comprised of '1' and 'zeroes', The subsystem than performs a bitblt, with an arithmetic and logic unit (ALU) function, whereby a destination pixel is written to an on-screen destination memory 25. If pixel datum is a '1', a foreground color and foreground ALU function are used to write the destination pixel. If pixel datum is a '0', a background color and background ALU function are used to write the destination pixel. The result is data representing the pixels in color stored in memory 25.

FIG. 3 illustrates operation of one embodiment of the present invention. A packed monochrome bit map 27 the bit map defining the number "one" being illustrated) is stored in RAM 7, and passes via bus 3 to the accelerator system 9. In a graphic based system such as Windows the packed monochrome text data is stored in off-screen memory 23. In the prior art the text data is stored in off-screen memory 23 in sparse monochrome form, as shown in FIG. 2, and as noted above. Now a bitblt operation is performed, by which each pixel of the packed cell data in memory 23 is expanded by adding color data and is moved to an on screen memory 25.

Once the data has been expanded it will be in the form utilized by the GUI, since the letter shape and size and its attributes will have been defined in the original monochrome bit map. Some characters will take up a larger number of pixels than others.

Thus in contrast to the prior art in which the main processor sends data to the accelerator to define the data using two bytes (dedicated text mode as in CGA, MDA, EGA and VGA) which is stored in and bitblt processed from a sparse bitmap, or in a GUI environment such as Windows which runs in APA (all points addressable or graphics) mode in which all character data is passed to the accelerator, the present invention utilizes the arbitrarily sized text kernel packed monochrome bitmaps for each character provided by the GUI program and stores them in the off-screen memory unmodified, ready for the subsequent bitblt operation. Thus the bitblt process need only expand each bit in the packed monochrome data provided by the GUI program by adding color in the bitblt operation, rather than expanding the complete bitmap including color data as in the prior art. Since the same character information is now packed into a smaller amount of memory due to it being a monochrome bitmap, now less data traffic is required to pass across the host expansion bus, and less memory bandwidth is required for reading the monochrome source. Also, no CPU processing is required (to make it sparse) before moving the data to graphics off screen memory.

FIG. 4 is a schematic illustrating another embodiment of the invention. Assume that a source cell 33A is being operated upon in a bitblt operation to a destination cell 34, shown as a destination rectangle. The source cell 33A is being read in an X direction (say, to the right), and the destination rectangle is being written, in the direction shown by dashed arrow 36. The destination cell boundary 37 is reached, and the destination writing pointer advances in the Y direction (say, down). In accordance with this embodiment, the source read pointer is automatically skipped to the next byte, which defines the beginning of the next line of pixels.

Since the accelerator can itself determine when to scan successive lines of pixels based on the extent of the destination cell, there is no need for modification of the source data prior to storage in the cache memory 23. Thus in a GUI such as Windows, the bitmap data can be stored directly into the off-screen memory without modification by the host, reducing the host CPU overhead.

In accordance with another embodiment, destination rectangles can have programmable destination side effects. Since written language tends to proceed in a particular direction, during a bitblt operation, the data cell coordinates are offset so as to be stored in the on-screen destination memory either to the right, the left, below or above those of a previous cell.

For example, as illustrated in FIG. 5, character cells 39A–39D, each containing a bit map is stored in a standard way in cache memory 23. During the bitblt operation, an ALU operation is performed on their coordinates which add an offset, causing source bitmap 39A to be stored at destination 41A, source bitmap 39B to be stored at destination 41B, source bitmap 39C to be stored at destination 41C, and source bitmap 39D to be stored at destination 41D. The source bitmaps are read randomly in accordance with the requirements of the data to be displayed, while the destination bitmaps are written in a directional order.

Thus for example if the destination coordinates are DST_X and DST_Y for the X and Y coordinates, two bits can be defined in an accelerator register which individually control those coordinates, the two bits being defined as tiling bits DST_X_TILE and DST_Y_TILE.

The table below illustrates the effects of the tiling bits being set or not set:

| Destination Trajectory | DST_X_TILE is set | DST_X_TILE is not set | DST_Y_TILE is set | DST_Y_TILE is not set |
|---|---|---|---|---|
| Left to right | aDST_X = bDST_X + DST_WIDTH | aDST_X = bDST_X | N/A | N/A |
| Right to left | aDST_X = bDST_X − DST_WIDTH | aDST_X = bDST_X | N/A | N/A |
| Top to bottom | N/A | N/A | aDST_Y = bDST_Y + DST_HEIGHT | aDST_Y = bDST−Y |
| Bottom to top | N/A | N/A | aDST_Y = bDST_Y − DST_HEIGHT | aDST_Y = aDST_Y |

In the above table, a DST_X is the coordinate value held in a DST_X register after the bitblt operation and bDST_X is the coordinate value held in the DST_X register before the bitblt operation.

It can be seen that the destination X and Y coordinates can be programmed to land at the original destination position (when the DST_X_TILE or DST_Y_TILE is not set), or can be offset from the original X position by the destination width and/or offset from the original Y position by the destination height.

In this manner, each monochrome to color expansion bitblt may be performed in quick succession, for any language style, without explicitly setting the DST_X and DST_Y registers, thus reducing data and control signal communication traffic across the expansion bus.

It should also be noted that a programmable value can be used for each of the X and Y directions, instead of the pixel lengths DST_WIDTH or DST_HEIGHT coordinates. This can be used to optimize intercharacter spacing, for example.

It will be recognized that any of the embodiments described above can be used individually, or in combination with one or more of the other embodiments.

A person understanding this invention may now conceive of alternative structures and embodiments or variations of the above. All of those which fall within the scope of the claims appended hereto are considered to be part of the present invention.

We claim:

1. A method of providing text data for display in a processor controlled apparatus comprising:

(a) storing data defining a text character in a memory, in packed monochrome bit map form, (b) addressing the memory to read the text character data, (c) providing the text character in packed form to a graphics processor circuit, (d) performing a bitblt operation on each bit of the packed form of text character while providing a color attribute, and (e) storing the packed text character having a color attribute for subsequent display.

2. A method of providing text data for display in a processor controlled apparatus as defined in claim 1 further comprising:

(f) storing said data defining a text character in a graphics accelerator memory, (g) performing the bit block transfer (bitblt) operation on the text character comprising reading source bit defining a block of text characters line by line in an X direction, (h) defining a destination pointer for each block with X and Y coordinates, (i) adding an offset to one of the X and Y coordinates, and (j) writing the text character to a destination, whereby each text character block is written to said destination, offset from a previous block by said added offset, for subsequent display in a predetermined order in said destination.

3. A method as defined in claim 2 in which said offset is one of zero, in which the X and Y coordinates of the destination are not offset from a previous destination block position defined by a character pixel sequence; in which the X coordinate of the destination is positive and is offset to the right of a previous destination and the Y coordinate is zero and is not offset from a previous destination block position; in which the X coordinate of the destination is negative and is offset to the left of a previous destination and the Y coordinate is zero and is not offset from a previous destination block position; in which the X coordinate is zero and is not offset from a previous destination position and in which the Y coordinate is positive and is offset downward from a previous destination position; and in which the X coordinate is zero and is not offset from a previous destination position and the Y coordinate is negative and is offset upward from a previous destination position.

4. A method as defined in claim 3 in which values of said positive and negative coordinate offsets are equal to a pixel length of a character block width and height respectively.

5. A method as defined in claim 3 including storing by means of a program values of said offsets and using said values during the bitblt operation.

6. A method as defined in claim 3 in which the coordinate offsets have values multiplied by −1.

7. A method of providing text data for display in a processor controlled apparatus comprising:

(a) storing data defining a text character in a memory, (b) performing a bit block transfer (bitblt) operation on the text character by moving a source block of pixels of the text character from a source portion of the memory to a destination portion of the memory, (c) the bitblt operation being performed by (i) reading pixels in an X direction from the source block of pixels until the end of a destination block of pixels is reached while writing said pixels in an X direction to the destination portion of the memory, (ii) advancing a destination block of pixels pointer in a Y direction which is orthogonal to the X direction and resetting the destination block to an X origin of said destination block of pixels, and (iii) reading a next line of the source block of pixels in an X direction from the beginning of a next byte of the source block of pixels while skipping any bits in a preceding line of the source block of pixels remaining unread.

8. A method of providing text data for display in a processor controlled apparatus as defined in claim 7, in which the data defining a text character is stored in a graphics accelerator memory, and in which the bitblt operation includes the steps of:

(I) defining a destination pointer for each block with x and Y coordinates, (II) adding an offset to one of the X and Y coordinates, and (III) writing the text character to a destination, whereby each text character block is written to said destination, offset from a previous block by said added offset, for subsequent display in a predetermined order in said destination.

9. A method as defined in claim 8 in which said offset is one of zero, in which the X and Y coordinates of the destination are not offset from a previous destination block position defined by a character pixel sequence; in which the X coordinate of the destination is positive and is offset to the right of a previous destination and the Y coordinate is zero and is not offset from a previous destination block position; in which the X coordinate of the destination is negative and is offset to the left of a previous destination and the Y coordinate is zero and is not offset from a previous destination block position; in which the X coordinate is zero and is not offset from a previous destination position and in which the Y coordinate is positive and is offset downward from a previous destination position; and in which the X coordinate is zero and is not offset from a previous destination position and the Y coordinate is negative and is offset upward from a previous destination position.

10. A method as defined in claim 9 in which values of said positive and negative coordinate offsets are equal to a pixel length of a character block width and height respectively.

11. A method as defined in claim 9 including storing by means of a program, values of said offsets and using said values during the bitblt operation.

12. A method as defined in claim 9 in which the coordinate offsets have values multiplied by −1.

* * * * *